United States Patent [19]

Schummer et al.

[11] Patent Number: 4,605,449

[45] Date of Patent: Aug. 12, 1986

[54] PROCESS FOR PRODUCING A ROLLED STEEL PRODUCT HAVING HIGH WELDABILITY, A HIGH YIELD STRENGTH AND A GOOD NOTCH IMPACT TOUGHNESS AT VERY LOW TEMPERATURES

[75] Inventors: Arthur Schummer; Jean de la Hamette; Guy Lessel; Jean-Paul Beck, all of Esch; Armand Frantz, Luxembourg, all of Luxembourg

[73] Assignee: Arbed S.A., Luxembourg, Luxembourg

[21] Appl. No.: 695,386

[22] Filed: Jan. 28, 1985

Related U.S. Application Data

[63] Continuation-in-part of Ser. No. 265,070, May 19, 1981, abandoned.

[51] Int. Cl.[4] ..... C21D 7/14; C21D 9/52

[52] U.S. Cl. ..... 148/12 B; 148/12 F

[58] Field of Search ..... 148/12 B, 12 E, 36, 148/12 R, 12 F

[56] References Cited

U.S. PATENT DOCUMENTS

| | | | |
|---|---|---|---|
| 3,811,873 | 5/1974 | de Barbadillo, II | 148/36 |
| 3,926,687 | 12/1975 | Gondo et al. | 148/12 B |
| 4,175,985 | 11/1979 | Blondelot et al. | 148/12 B |
| 4,272,305 | 6/1981 | Weingerl et al. | 148/12 E |

FOREIGN PATENT DOCUMENTS

| | | | |
|---|---|---|---|
| 56120 | 5/1978 | Japan | 148/12 B |

OTHER PUBLICATIONS

Simoneau et al., "Modified Charpy Hammer Simulation of Steckel Mill Rolling of Nb Microalloyed Steels", Metals Technology, Nov. 1980, pp. 456–464.

Schummer, "Microalloyed Steels for Hot-Rolled and Cold-Formed Shapes and Concrete-Reinforcing Bars", Micro Alloying 75, Conference held Oct. 1-3, 1975, Washington, D.C., Session 2A, pp. 48-55.

*Primary Examiner*—Wayland Stallard

*Attorney, Agent, or Firm*—Karl F. Ross; Herbert Dubno

[57] ABSTRACT

A process for producing rolled steel products, especially reinforcing rod for concrete or other elements to be encased in concrete and having good weldability, a high yield strength and high energy absorption for the Charpy V impact test at very low temperatures comprising forming a silicon and aluminum containing steel whose carbon content (C), manganese content (MN), and niobium content (NB) are related by the relationship set forth below. The steel blank is rolled so that the last three passes result in more than 20% of the total cross section reduction, these rolling passes are carried out so that the temperature T1 before, the temperature T2 during, and the temperature T3 after rolling are also related to the diameter D in the manner set forth below to yield a high yield strength LE and a high energy absorption expressed as KCV at −120° C. The relationships are:

$$LE=1035+510\,C+192\,MN+2270\,NB-0.21\,T1-0.42\,T2-0.48\,T3-3.51\,D$$

and $$KCV=2202-2066\,C+23.20\,MN-2064\,NB-0.77\,T1-1.24\,T2-0.23\,T3-1.98\,D.$$

5 Claims, No Drawings

PROCESS FOR PRODUCING A ROLLED STEEL PRODUCT HAVING HIGH WELDABILITY, A HIGH YIELD STRENGTH AND A GOOD NOTCH IMPACT TOUGHNESS AT VERY LOW TEMPERATURES

CROSS-REFERENCE TO RELATED APPLICATION

This application is a continuation-in-part of Ser. No. 265,070 filed May 19, 1981, now abandoned.

FIELD OF THE INVENTION

Our present invention relates to a process for producing rolled steel products and especially rolled steel strip or rod stock, particularly rod which can be embedded in concrete as concrete reinforcing rod, which have high weldability, a high yield strength and a high notch impact toughness at very low temperatures.

BACKGROUND OF THE INVENTION

While rolled steel products can be fabricated with a variety of cross sectional shapes for concreting, i.e. embedding or sheathing in concrete, it is of particular interest to provide rolled steel stock in rod or bar shape which can be incorporated in concrete vessels as reinforcing rings or the like as will be discussed in greater detail below. Such stock, adapted to be sheathed, embedded or encased in concrete will be referred to hereinafter as concrete bar or as rolled stock or by terms of similar significance.

It is known to provide concrete bar having a yield strength of the order of 400 N/mm$^2$ but which only have a low toughness. Thus their transition temperature for energy absorption for the Charpy V impact test at 35 J/cm$^2$ is of the order of +20° C. It follows that such rolled products do not possess any significant ductility at lower temperatures.

However, it is of increasing interest to be able to form reinforced concrete vessels which are capable of operating at temperatures well below this transition temperature and ambient temperature. For example, it is desirable to fabricate concrete vessels for containing liquefied natural gas or other liquefied gases at temperatures which may be as low as −196° C. and hence to provide concrete reinforcing steel stock which has a high energy absorption as low as this temperature and, more particularly, has a transition temperature for the energy absorption for the Charpy V impact test at 35 J/cm$^2$ of the order of −196° C.

Low-cost concrete bar stock was not previously available.

Consequently, in the cryogenic field and especially the field of low temperature gas storage, it has been necessary to utilize large quantities of expensive reinforcing steels having a good ductibility at low temperature. The reinforcing steels could be embedded in concrete surrounding a storage tank for low temperature liquefied gas in the same manner as concrete containment vessels were applied in the nuclear reactor field.

In order to be suitable for use as a reinforcement for a concrete containment around a liquefied gas reservoir which is subjected to temperatures between −50° C. and −196° C., the concrete bar must have a high notch impact toughness throughout its cross section, and be easily welded, thereby employing a carbon level less than 0.2% by weight. When conventional concrete bar containing 0.16 to 0.2% carbon are subjected to cold twisting, it is frequently noted that they may have a sufficient yield strength but an insufficient toughness at the lower temperatures.

When attempts are made to have carbon contents lower than 0.2% and the bar are rapidly cooled at their surface upon leaving the rolling line, an autotempering occurs which yields weldable and tough bar but with a notch impact toughness such that the transition temperature of the Charpy V 35 J/cm$^2$ test is about −50° C.

It is possible to provide concrete bar utilizing a steel alloy with 9% nickel and which is subjected to a double normalizing followed by a tempering or quenching followed by a tempering to achieve an energy absorption of 35 J/cm$^2$ for the Charpy V impact test with a transition temperature of −196° C.

However, such additional heat treatments are time consuming and expensive, as is the resulting alloy.

OBJECTS OF THE INVENTION

It is the principal object of the present invention to provide a process for producing rolled products having the advantageous characteristics mentioned previously, i.e. good weldability, high yield strength and high notch impact test values at low temperatures which utilizes exclusively the heat during the rolling process, i.e. is free from the need for additional heat treatment subsequent to rolling.

Another object of this invention is to provide rolled products for the purposes described, especially concrete bar, adapted to be utilized effectively at extremely low temperatures and containing a minimum of alloying elements so that the bar stock is of comparatively low cost.

Still another object is to extend the principles of the application identified above.

SUMMARY OF THE INVENTION

We have discovered, surprisingly, that a comparatively low alloy steel containing manganese, silicon, and/or niobium and/or vanadium and/or molybdenum can be fabricated with a high yield strength and a high notch impact toughness as measured by the Charpy V test by casting billets from the alloy and subjecting the alloy to rolling in a multiplicity of rolling passes of which, for the purposes of the present invention, the last three passes are critical as will be described below.

We have found that it is possible to dimension the proportions of the carbon, manganese and niobium of the alloy with respect to the temperatures prior to, during and after rolling with respect to the diameter of the finished product to yield a well defined yield strength and high energy absorption at temperatures as low as −120° C. or below.

More particularly, billets of the aforementioned alloy are rolled so that the proportions of total cross section reduction effected during the last three rolling passes is greater than 20%, i.e. the billets are so rolled that the three passes effect more than 20% of the total cross section reduction in the formation of a concrete bar. Under these conditions and with control of the temperature before, during and after rolling of the product, the desired levels of the yield strength and the energy absorption for the Charpy V impact test at −120° C. can be obtained according to the following relationships:

$$LE=1035+510C+192MN+2270NB-0.21T1-0.42T2-0.48T3-3.51D$$

and $$KCV=2202-2066C+23.20MN-2064NB-0.77T1-$$
$$-1.24T2-0.23T3-1.98D$$

In the foregoing relationship LE is the yield strength in MPa. KCV is the energy absorption for the Charpy V impact test at −120° C. in Joules.

C is the carbon content in percent.

MN is the manganese content in percent.

NB is the niobium content in percent.

TI (−) is the temperature prior to rolling.

T2 is the mean temperature during rolling.

T3 is the temperature of the rolled product immediately following the last rolling step.

D is the diameter of the rolled product.

It will also be apparent that the concentrations of the various elements added to the steel, and the temperatures at different phases of the treatment can be varied within the limits defined by the aforementioned relationships.

However, we have found that there are certain constraints which should be observed for the most effective results (all percent by weight). For example, we have found that the carbon content should be well below 0.20% and preferably should be a maximum of 0.08% for the highest energy absorption at low temperatures, i.e. for a transition temperature Charpy V 35 J/cm$^2$ of −140° C. We have found also that the manganese level should be of the order of 1.7 (±0.2%) to provide an effective toughness to steel while improving its yield strength. The silicon content should be of the order of 0.3% (±0.1%) for high strength.

The steel should have been killed with aluminum so that at least a trace of aluminum (at least 0.03% and up to 0.3%) remains, thereby ensuring a fine grain, reduced tendency to aging and high weldability. The refining of the grain increases the yield strength and thus the toughness of the product.

The niobium can be present in amounts up to about 0.3% and, when vanadium or molybdenum are present, the proportions of these components can also be up to 0.3%. These elements ensure a high yield strength, especially for concrete bar of large diameter. The bar diameter can be of any convenient size and preferably ranges between 10 mm and 30 mm.

It will thus be apparent that the mill product is subjected according to the invention to a very specific thermo-mechanical process in the course of which the temperature of the product is controlled during all the operations before, during and after rolling. The critical temperatures T1, T2 and T3, however, can be those which apply before, during and after the last three rolling steps of the process where these last three steps bring about at least 20% of the total cross section reduction throughout the rolling process, but preferably are the temperatures before, during and after the entire rolling process.

The rolling process of the invention has been found to yield a grain structure in the finished product which is extremely fine and extends throughout the cross section of the product thereby assuring that the high impact toughness at lower temperature also extends throughout the cross section of the rolled product.

To achieve this result the temperatures which are selected should be designed to avoid an increase in the growth of the grain during the rolling process, the starting temperature at the commencement of rolling being sufficient to allow grain refining but such that significant recrystallization does not occur. The temperature T1, for example, can be 1000° C.±100° C. while the temperature T2 can be 800° C.±75° C. and the temperature T3 can be 650° C.±50° C.

During the rolling process prior to the last three passes the rolled body is subjected to rapid cooling along a cooling curve which is comparatively steep until a temperature close to or equal to the Ar3 transformation point.

After the last pass the body can be force cooled by quenching in liquid air to a temperature sufficiently low as to avoid any recrystallization.

Thus the present invention provides a combination of benefits deriving from the judicious choice of the elements incorporated in the steel with the temperature resulting during rolling and the degree of reduction to yield an extremely fine-grain finished product.

It has been found to be advantageous when the steel should have a high energy absorption at temperatures below −140° C. or a transition temperature of the Charpy V 35 J/cm$^2$ below −100° C. to utilize a steel containing nickel. The nickel content, however, can be well below 10% and even substantially below 9%, being of the order of about 5% for a Charpy V 35 J/cm$^2$ resilience of −196° C.

The advantages of the process will be apparent from six specific tests described below:

1. Rolling of naturally hard steel into concrete bar (containing a carbon concentration of about 0.35%) to yield a product of satisfactory strength and a yield strength above 400 MPa.

The transition temperature by the Charpy V test at an energy level of 30 J/cm$^2$ of this product is not below +20° C. so that the steel has no significant toughness at low temperatures. The weldability of the steel is also mediocre.

2. A steel having a carbon content limit of 0.18% treated in accordance with the invention, i.e. having temperatures controlled before, during and after rolling. The transition temperature was reduced to −60° C. and the elongation was improved. The steel was weldable.

3. The steel has the chemical composition of the invention but was not subjected to controlled rolling. The yield strength and tensile strength were at a low level. The elongation was high. The transition temperature was approximately that contained in example 2.

4. This steel has the chemical composition of the invention and was treated in accordance with the invention, i.e. underwent controlled rolling. The transition temperature was extremely low, the elongation was higher, the tensile strength and the yield strength were both high.

5. Test Example 5 was a 9% nickel steel subjected to conventional rolling and had a transition temperature of Charpy V 35 J/cm$^2$ of −50° C.

6. The same steel as in test 5 but subjected to double normalizing or quenching and tempering to yield a transition temperature of −196° C., the rolling step 6 carried out by the controlled process of the invention.

The results of these six examples are summarized in Table 1.

The following tests, summarized in Table 2, demonstrate the importance of the chemical composition, the control of the temperature during the process and the rapid postrolling cooling.

7. A naturally hard steel for concrete bar (C=about 0.35%) treated according to the process of the invention is quenched to the core. This steel has a high yield strength but poor ductility and even in ambient temperature the energy level by the Charpy V test does not exceed 35 J/cm$^2$.

8. The steel of the composition of the invention but without application of the treatment according to the invention has a low yield strength and tensile strength and the transition temperature by the Charpy V impact test does not extend below −60° C.

9. The same steel as in 8 with postrolling cooling but without the thermomechanical treatment of the invention. The yield strength and tensile strength are clearly higher than the example 8 and the transition temperature (−75° C.) is equally improved thereover.

10. The steel is handled as in 9 except that a controlled thermomechanical process only for the last stages in rolling is effected, i.e. the temperature prior to rolling is not controlled. The yield strength and tensile strength are improved as is the transition temperature.

11. The steel and process of 9 were used but without postrolling cooling and with control of the thermomechanical treatment for all rolling operations. The yield strength and tensile strength are lower than those of Examples 9 and 10 but the transition temperature is improved.

12. The product and process of 11 but with controlled thermomechanical treatment throughout the rolling process and postrolling cooling. All critical parameters improved.

In all of the foregoing tests, unless otherwise indicated, when reference was made to the composition according to the invention, the carbon content was 0.08% by weight, the manganese content was 1.60% by weight, the niobium content was 0.05% by weight, the silicon content was 0.3% by weight and the aluminum content was 0.2% by weight. All bars were processed to the same diameter, 16 mm, in the same number of rolling mill passes.

The conclusion below provides an example of the application of the relationships of the invention:

$$LE=1035+510C+192MN+2270NB-0.21T1-0.42T2-0.48T3-3.51D \text{ (MPa)}$$

$$KCV=-120° \text{ C.}=2202-2066C+23.20MN-2064NB-0.77T1-1.24T2-0.23T3-1.98D \text{ (Joules)}$$

Parameters:

C=0.08% carbon,
MN=1.60% Mn,
NB=0% Nb
T1−1000° C.,
T2=800° C.,
T3=650° C.
D=16 mm
LE=469 MPa
KCV=130 Joules at −120° C.

While this description has concentrated on the production of concrete bar it is also applicable to rolled products of all types and cross sections where it is desired to obtain the properties of weldability, high yield strength and high energy absorption for the Charpy V impact test at very low temperatures. For bars of other round configuration the diameter D in the relationships given can be replaced by the maximum cross sectional dimensions through the solid.

Preferably the billet, formed of an alloy of a composition in accordance with the invention is heated in a furnace to a control temperature less than 1200° C. and preferably of the value T1 prior to rolling, is rolled in a multiplicity of passes greater than three to the final diameter D and is cooled rapidly following rolling to the temperature T3.

TABLE 1

| No example | 1 | 2 | 3 | 4 | 5 | 6 |
|---|---|---|---|---|---|---|
| Type of steel | C = 0.35% semi-killed | C = 0.18% semi-killed | C = 0.08% killed | C = 0.08% killed | 9% Ni killed | 9% Ni killed |
| Treatment according to the invention before, during and after rolling | no | yes | no | yes | no | yes |
| Yield Strength (MPa) | 440 | 470 | 320 | 490 | 890 | 710 |
| Tensile Strength (MPa) | 650 | 570 | 500 | 570 | 1010 | 940 |
| Elongation 10 d (%) | 13 | 25 | 25 | 30 | 9 | 13 |
| Temp. of transition °C., energy absorption for Charpy V impact test 35 J/cm$^2$ | +20 | −60 | −60 | −140 | −50 | −196 |

TABLE 2

| No example | 7 | 8 | 9 | 10 | 11 | 12 |
|---|---|---|---|---|---|---|
| Type of steel | C = 0.35% semi-killed | C = 0.05% Al killed | C = 0.05% Al killed | C = 0105% Al killed | C = 0.05% Al killed | C = 0.05% Al killed |
| Furnace temperature | controlled | 1200° C. | 1200° C. | 1200° C. | controlled | controlled |
| Temperature before rolling | controlled | non controlled | non controlled | non controlled | controlled | controlled |
| rapid intermediate cooling | yes | no | no | yes | yes | yes |
| Temperature at end of rolling | controlled | non controlled | non controlled | controlled | controlled | controlled |
| rapid cooling after rolling | yes | no | yes | yes | no | yes |

TABLE 2-continued

| No example | 7 | 8 | 9 | 10 | 11 | 12 |
|---|---|---|---|---|---|---|
| Temperature after post rolling cooling | controlled | — | controlled | controlled | — | controlled |
| Yield Strength (MPa) | 980 | 320 | 430 | 470 | 380 | 490 |
| Tensile Strength (MPa) | 980 | 480 | 530 | 550 | 465 | 580 |
| Elongation (5 d) % | 5% | 34% | 32% | 31% | 36% | 32% |
| Temperature of transition (°C.) for Charpy V impact test 35 J/cm$^2$ | >+20° C. | −60° C. | −75° C. | −100° C. | −115° C. | −140° C. |

Using the relationships given above the following rebars were made with the KCV values set forth: (concentration in percent, temperature in degrees C., all KCV at −120° C.)

C=0.05
MN=1.65
NB=0.032
T1=1000°
T2=800°
T3=650°
Diameter: 32 MM
LE=480 MPa
KCV=96 J C=0.05
MN=1.65
NB=0.032
T1=950
T2=800
T3=650
Diameter: 32 MM
LE=490 MPa
KCV=135 J C=0.07
MN=1.45
NB=0
T1=950
T2=800
T3=650
Diameter: 20 mm
LE=431 MPa
KCV=178

C=0.08
MN=1.62
NB=0.027
T1=950
T2=800
T3=650
Diameter: 25 MM
LE=513 MPa
KCV=96 J C=0.08
MN=1.62
NB=0.027
T1=1000
T2=800
T3=580
Diameter: 25 MM
LE=536 MPa.
KCV=74 J

We claim:

1. A process for producing rolled bodies of steel having a high yield strength, high energy absorption for the Charpy V impact test at very low temperatures and good weldability, especially concrete reinforcement bars, comprising the steps of:

forming a billet of a steel alloy essentially consisting of carbon in a concentration of less than 0.20% C, manganese, in a concentration MN, silicon in a concentration up to about 0.5%, molybdenum and vanadium in concentrations up to 0.3%, aluminum in a concentration of 0.03 to 0.3% and niobium in a concentration of NB of up to 0.3%, the balance iron;

heating said billet in a furnace to a control temperature T1 of 1000° C.±100° C. prior to rolling;

rolling the heated billet in a multiplicity of rolling passes to a bar of a diameter D;

cooling the billet prior to the last three rolling passes to a temperature corresponding to the transformation point Ar3;

cooling said billet following rolling by forced cooling throughout its cross section to a temperature below the recrystallization temperature of the alloy; and controlling the temperature T1 prior to rolling, the temperature T2 which is 800° C.±75° C. during rolling, the temperature T3 which is 650° C.±50° C. subsequent to rolling and said concentrations in accordance with the relationships:

$$LE=1035+510C\pm192MN+2270NB-0.21T1-0.42T2-0.48T3-3.51D$$

and $$KCV=2202-2066C+23.20MN-2064NB-0.77T1-1.24T2-0.23T3-1.98D$$

where LE is a high elastic limit in MPa and is at least 450 MPa and KCV is the energy absorption in Joule and is at least 35 Joule for a Charpy V impact test at −120° C.

2. The process defined in claim 1 wherein the steel alloy is formed in a melt which is killed with aluminum so that said billet contains at least 0.03% aluminum.

3. The process defined in claim 2 wherein the billet is heated in said furnace to a control temperature less than 1200° C.

4. The process defined in claim 1 wherein said temperature T1 is about 1000° C., said temperature T2 is about 800° C., said temperature T3 is about 650° C. and the carbon content of the alloy is at most 0.08% carbon.

5. A process for producing concrete reinforcing bar steel having a high yield strength, high energy absorption for the Charpy V impact test at very low temperatures and good weldability, comprising the steps of:

forming a billet of a steel alloy containing carbon in a concentration C of less than 0.20%, manganese in a concentration MN, silicon, aluminum and niobium in a concentration of NB, said steel alloy essentially consisting of carbon, manganese, silicon, aluminum, niobium, molybdenum in a concentration up to 0.3%, vanadium in a concentration up to 0.3%, and the balance iron;

heating said billet in a furnace to controlled temperature T1 of 1000°±100° C. prior to rolling;

rolling the heated billet in a multiplicity of rolling passes to a bar of a diameter D; and controlling the temperature T1 prior to rolling, the temperature T2 which is 800° C.±75° C. during rolling, the temperature T3 which is 650° C.±50° C. subsequent to rolling and said concentrations in accordance with the relationships:

$$\text{yield strength} = 450\ \text{MPa} < 1035 + 510C + 192MN + 2270NB + 0.21T1 - 0.42T2 - 0.48T3 - 3.41D$$

and $$\text{Joules} < 2202 - 2066C + 23.20MN - 2064NB - 0.77T1 - 1.24T2 - 0.23T3 - 1.98D$$

for a Charpy V impact test at −120° C.

* * * * *